US006102011A

United States Patent [19]

Meyer et al.

[11] Patent Number: 6,102,011

[45] Date of Patent: Aug. 15, 2000

[54] IN-TANK FUEL DELIVERY SYSTEM FOR MARINE VESSELS

[75] Inventors: Paul M. Meyer; Bruce Stephens, both of Fairfield, Ill.

[73] Assignee: UIS, Inc., Jersey City, N.J.

[21] Appl. No.: 09/188,162

[22] Filed: Nov. 7, 1998

[51] Int. Cl.[7] ..... F02M 33/04

[52] U.S. Cl. ..... 123/509; 123/457

[58] Field of Search ..... 123/509, 495, 123/497, 510–11, 457–8

[56] References Cited

U.S. PATENT DOCUMENTS

| | | | |
|---|---|---|---|
| 4,716,931 | 1/1988 | Shibamoto | 123/509 |
| 4,878,518 | 11/1989 | Tuckey . | |
| 5,038,741 | 8/1991 | Tuckey . | |
| 5,070,849 | 12/1991 | Rich et al. . | |
| 5,218,942 | 6/1993 | Cohen et al. . | |
| 5,303,685 | 4/1994 | Forgacs | 123/510 |
| 5,368,001 | 11/1994 | Roche | 123/510 |
| 5,415,146 | 5/1995 | Tuckey . | |
| 5,431,143 | 7/1995 | Brown . | |
| 5,520,156 | 5/1996 | Brunnhofer | 123/510 |
| 5,613,476 | 3/1997 | Oi et al. | 123/509 |
| 5,613,844 | 3/1997 | Tuckey et al. . | |
| 5,636,616 | 6/1997 | Okane et al. | 123/510 |
| 5,662,089 | 9/1997 | Kleppner et al. | 123/509 |
| 5,692,479 | 12/1997 | Ford et al. . | |
| 5,762,047 | 6/1998 | Yoshioka | 123/509 |
| 5,762,049 | 6/1998 | Jones et al. | 123/509 |
| 5,785,032 | 7/1998 | Yamashita et al. | 123/509 |
| 5,787,865 | 8/1998 | Harris et al. | 123/509 |
| 5,809,975 | 9/1998 | Tuckey et al. . | |

*Primary Examiner*—Thomas N. Moulis
*Attorney, Agent, or Firm*—Polster, Lieder, Woodruff & Lucchesi, LC

[57] ABSTRACT

A fuel delivery system (10) used on marine vessels (B) has a fuel injected, internal combustion engine (E) for propulsion. A fuel tank (T) stores fuel (F) supplied to run the engine through a supply line (L) extending between the fuel tank and the engine. The tank has a relatively small (1.6 in. diameter) opening (O), and a fuel pump (12) is sized to fit within the fuel tank through this opening. The fuel pump pumps fuel, under pressure, from the fuel tank to the engine. A fuel filter (20) is also sized to fit within the tank and is connected to an inlet (14) of the fuel pump. Fuel is drawn into the fuel pump through the fuel filter. A pressure regulator (30) regulates the pressure of fuel pumped to the engine. The pressure regulator is mounted externally of the tank and the fuel pump is tethered to the pressure regulator for the fuel pump and fuel filter to be installed in the fuel tank without use of external supporting structure.

16 Claims, 2 Drawing Sheets

IN-TANK FUEL DELIVERY SYSTEM FOR MARINE VESSELS

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

This invention relates to marine fuel systems, and more particularly, to an in-tank, tethered fuel delivery system which conveniently fits within an opening in a fuel tank on a boat and can be used with fuel tanks of various sizes.

In automobiles, depending upon the auto manufacturer, the fuel tank typically has an opening of 4–5 in. (10.1–12.7 cm.). However, in accordance with the Society of Automotive Engineers (SAE) standards, a fuel tank used in marine applications only has an opening on the order of 1.6 in. (4.1 cm.). Marine fuel tanks have a capacity ranging from a few gallons up to 250 gallons, and the geometry of the tanks varies widely, since boat designers try to fit tanks into whatever spaces are available within the hull.

In automobiles, it is known to be able to place one or more fuel system components within the tank, and the size of the tank opening readily allows these components to be installed and removed. However, these components cannot, and do not, fit in marine tanks having openings sized to the SAE specifications, and it has heretofore not been possible to install fuel system components within a marine fuel tank. What this has meant is that locations within the hull convenient to the fuel tank and marine engine have had to be found for mounting of these parts. Fuel line routings have had to be made and done so with assurance that boat safety is not compromised. For manufacturer's of fuel tanks, changeover from making fuel tanks for cars and trucks to making similar capacity tanks for boats has involved extensive retooling and the attendant cost.

BRIEF SUMMARY OF THE INVENTION

Among the several objects of the present invention may be noted the provision of an in-tank fuel delivery system for marine applications; the provision of such a fuel delivery system which is readily installed in tanks of various sizes and shapes; the provision of such a fuel delivery system that fits through a port in the tank sized to SAE specifications, this port being quite small; the provision of such a fuel delivery system to deliver fuel, in fuel injected systems, at pressures ranging from 20 psi up to 200 psi; the provision of such a fuel delivery system which is self-supporting within the tank and does not require any alteration to existing fuel tank construction to mount the components in the tank; the provision of such a fuel delivery system having a fuel pump and filter installed within the tank, and a pressure regulator installed outside the tank on a cover fitting over the tank opening, the fuel filter preventing dirt and water from being ingested into the fuel pump; and the regulator being readily replaceable without having to dismantle the system; and, the provision of such a fuel delivery system to simplify marine fuel system design and reduce the time and tooling costs involved for manufacturing fuel tanks.

In accordance with the invention, generally stated, a fuel delivery system is for use on marine vessels which have a fuel injected, internal combustion engine for propulsion. A fuel tank stores fuel which is supplied to run the engine through a fuel supply line extending between the fuel tank and the engine. The tank has a relatively small (1.6 in. diameter) opening, and a fuel pump is sized to fit within the fuel tank through this opening. The fuel pump pumps fuel, under pressure, from the fuel tank to the engine. A fuel filter is also sized to fit within the tank and is connected to an inlet of the fuel pump. Fuel is drawn into the fuel pump through the fuel filter. A pressure regulator regulates the pressure of fuel pumped to the engine. The pressure regulator is mounted externally of the tank and the fuel pump is tethered to the pressure regulator for the fuel pump and fuel filter to be installed in the fuel tank so to be self-supporting and not need external supporting structure. Other objects and features will be in part apparent and in part pointed out hereinafter.

BRIEF DESCRIPTION OF THE SEVERAL VIEWS OF THE DRAWINGS

In the drawings.

Corresponding reference characters indicate corresponding parts throughout the drawings.

DETAILED DESCRIPTION OF THE INVENTION

Figure 1:
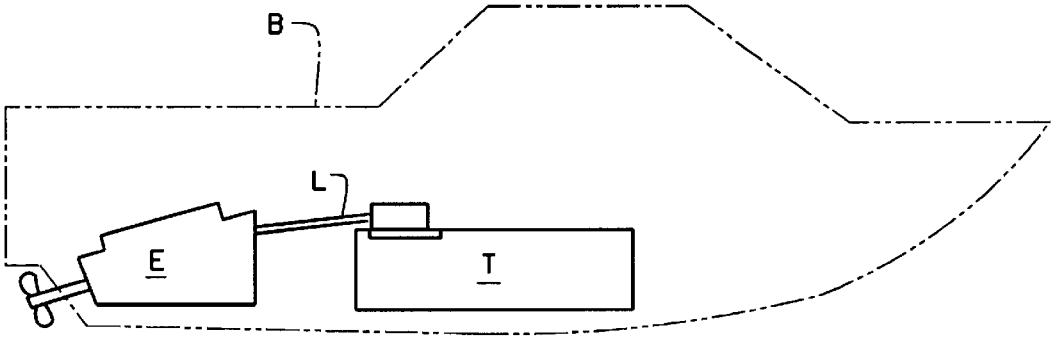
FIG. 1 is a simplified illustration of a boat with a fuel system for delivering fuel from a tank to an engine powering the boat.

Referring to the drawings, a boat B is powered by an internal combustion engine E which may be a fuel injected engine. Fuel F to power the engine is stored in a fuel tank T, both the engine and the tank being located within a hull of the boat. The fuel can be either gasoline or diesel fuel. A fuel line L extends between the tank and the engine for delivering fuel, under pressure, to the engine. Heretofore, the fuel system components have been located external to the tank and the components had to be conveniently mounted so fuel could be drawn from the tank and pumped to the engine. Now, in accordance with the present invention, these components, which comprise a fuel delivery system 10, are installed in the tank, or external to the tank on a cover C fitting over the opening. This arrangement greatly simplifies the fuel delivery system, and reduces the amount of space within the hull taken up by the fuel delivery system.

Figure 2:
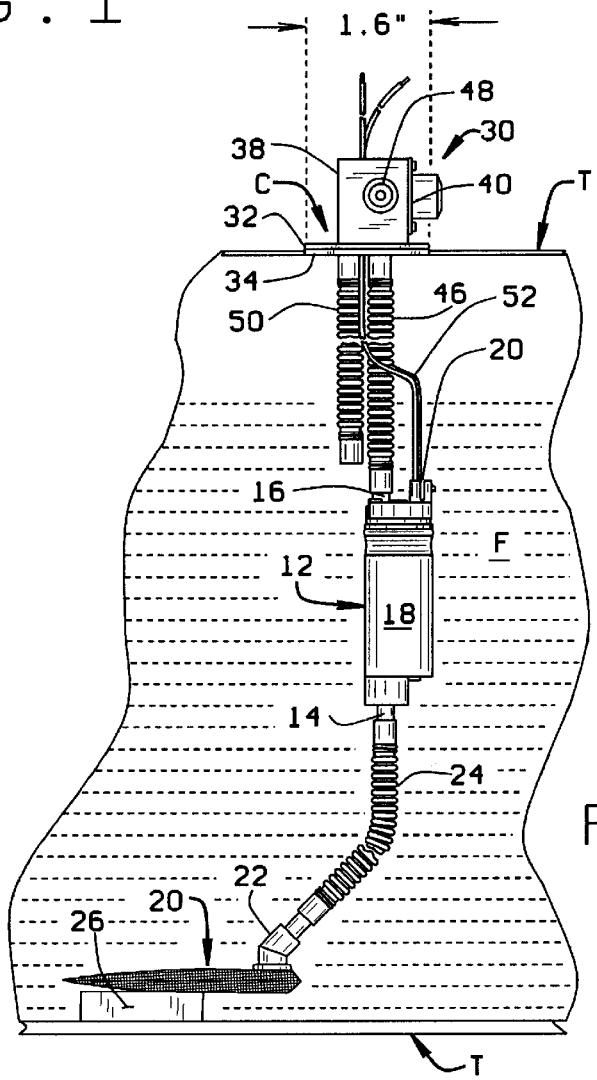
FIGS. 2 and 3 are elevational views of the fuel delivery system components as installed.
Figure 3:
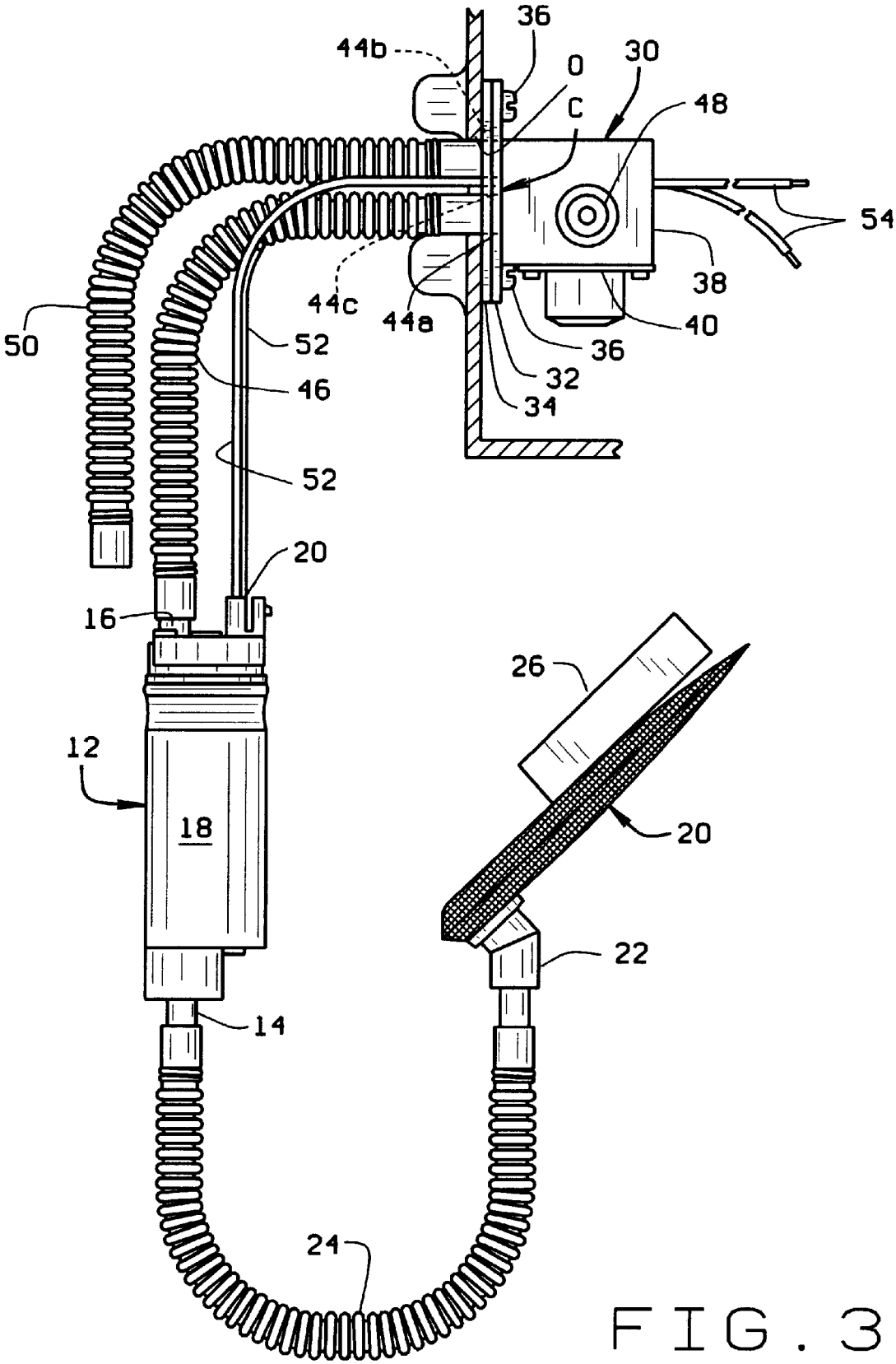

It will be noted that an opening O in fuel tank T, which opening is closed by cover C, is a small opening. The opening can be in a top wall of the tank, as shown in FIG. 2, or in a sidewall of the tank, as shown in FIG. 3. In accordance with SAE specifications, the opening is only 1.6 in. in diameter. The size of opening O is the same, even though tank T varies in size from a tank having a capacity of a few gallons, to a tank having a fuel carrying capacity of up to 250 gallons. Fuel delivery system 10 first includes a fuel pump 12 which fits in the tank through the opening. Fuel pump 12 has an elongate cylindrical pump body whose outer diameter is smaller than the diameter of opening O. The pump has a fuel inlet 14 at one end of the body and a fuel outlet 16 at its other end. The inlet and outlet extend longitudinally of a main body 18 of the fuel pump. The pump, which is a DC voltage powered pump, further has a pair of electrical connectors 20 at the outlet end, these connectors also being arranged parallel to the pump's longitudinal axis. Fuel pump 12 is, preferably, a roller vane pump, and is capable of delivering fuel at high flow rates, and at delivery pressures from 20 psi up to 200 psi.

Fuel delivery system 10 further includes a fuel filter 20 through which fuel is drawn into pump 12. The fuel filter is comprised of an automotive type strainer material for filtering dirt and water out of the fuel pump. The filter is generally rectangular in plan, and has a lengthwise tapering thickness. A fuel line connector 22 is located at the thicker end of the filter, on the top side of the filter, the connector having a "gooseneck" configuration. A flexible tube 24 has one end connected to connector 22, and the other end of the fuel line attaches to fuel pump inlet 14. Attached to filter 20, on the underside side of the filter, is a float 26. The float is formed of a thin rectangular sheet of a nitrophyl float material, for example. The float adds buoyancy to the filter, and the float, together with the flexible tube 24, allows the filter to flow through the fuel in the tank, and remain suspended in the fuel, regardless of the shape of the tank; or, the orientation of the tank as it is effected by the maneuvering of the boat. This assures a constant supply of fuel to the engine while the boat is turning, and while it is riding through swells and across waves.

Next, fuel delivery system 10 includes a pressure regulator 30 which is installed externally of tank T. Cover C includes a cover plate 32 sized to fit over opening O in the tank, and a sealing gasket 34. The cover plate and its associated gasket are secured to tank T by appropriate fasteners 36 such as threaded screws or the like. A housing 38 is formed on the outer surface of the cover plate and the pressure regulator fits in this housing. The pressure regulator includes a cover plate 40 which fits over an open end of the housing. Fasteners 42 again, threaded screws, for example, secure the pressure regulator in place. An advantage of this construction is that it allows the pressure regulator to be replaced without having to remove the fuel pump/fuel filter assembly from the tank. The pressure regulator may be removed if it is not functioning properly, or if engine E is replaced and the new engine requires a different regulator.

Cover plate 32 includes two fuel flow openings 44*a*, 44*b*, and two power line openings 44*c* only one of which is shown in the drawings. Opening 44*a* accommodates a connector by which a flexible hose 46 connects between outlet 16 of the fuel pump and a fuel inlet to the regulator. One end of fuel line L attaches to a fuel outlet 48 of the pressure regulator, this outlet being on a sidewall of the regulator external to the tank. Opening 44*b* accommodates a fuel return tube 50 which is also a flexible tube. This tube allows the pressure regulator to return fuel directly to the fuel tank. The openings 44*c* accommodate electrical power lines 52 by which fuel pump 12 is connected to a source of electrical power. Power to pressure regulator 30 is provided by electrical leads 54.

The above construction allows the fuel pump 12/fuel filter 20 subassembly to be tethered to the tank by the connection of the fuel pump to the pressure regulator. This allows the subassembly to move about within the tank, so that regardless of the movement of the boat and the consequent sloshing of fuel about in the tank, the fuel filter will always remain submerged in the fuel and assure a constant supply of fuel to engine E. Depending upon the size of the tank, the length of tube 46 and the electrical leads 52 will vary. For smaller tanks, the length of the hose is approximately 11 in. (28 cm.); while for larger tanks, the hose length is approximately 15 in. (38.1 cm.). It will be recognized by those skilled in the art that this system makes it possible to have a uniform tank opening for all sizes of marine fuel tanks. When manufacturing tanks, this saves significantly on production time and tooling costs. Further, because the fuel delivery system is tethered, it does not require any mounting or support structures within the interior of the tank. This not only reduces construction costs, since mounting brackets or the like to do not have to be built into the tank, but also saves on installation and repair costs because initial installation of the system does not require mounting pieces inside the tank, and subsequent maintenance or repair are simplified for the same reason.

What has been described is a self-supporting, in-tank fuel delivery system for marine applications, the system being usable in various size and shapes of tanks, and the system delivering fuel at pressures of up to 200 psi. The fuel delivery system is readily installed marine tanks whose post dimensions, in accordance with SAE specifications, are quite small. Importantly, the fuel delivery system and its assembled components provide a compact system which is readily adaptable to a wide variety of marine fuel tanks. The system employs a fuel pump and filter fitted inside the tank, and a pressure regulator mounted on a mounting flange adjacent the opening in the tank. Because of its location, the regulator is readily replaceable without having to remove system components from the tank. Use of the fuel delivery system simplifies fuel system design and reduces tooling costs for manufacturers of fuel tanks.

In view of the foregoing, it will be seen that the several objects of the invention are achieved and other advantageous results are obtained.

As various changes could be made in the above constructions without departing from the scope of the invention, it is intended that all matter contained in the above description or shown in the accompanying drawings shall be interpreted as illustrative and not in a limiting sense.

What is claimed is:

1. A fuel delivery system for use on marine vessels having an engine for propulsion, a fuel tank storing fuel supplied to the engine to run the engine, and a fuel supply line extending between the fuel delivery system and the engine, the fuel delivery system comprising:

a pressure regulator regulating the pressure of fuel pumped to the engine, the pressure regulator being mounted externally of the fuel tank;

a fuel pump sized to fit within the fuel tank for pumping fuel, under pressure, between the fuel delivery system and the engine;

a fuel filter also sized to fit within the fuel tank, said fuel filter resting in the fuel and connected to an inlet of the fuel pump for fuel in the tank to be drawn into the fuel pump through the fuel filter; and, said fuel pump tethered by a flexible hose to the pressure regulator for the fuel pump and fuel filter to be installed and operate in the fuel tank without use of other supporting structure.

2. The fuel delivery system of claim 1 wherein the fuel tank has an opening therein approximately 1.6 inches in diameter, and the fuel pump and fuel filter are sized to fit through this opening.

3. The fuel delivery system of claim 2 further including a cover plate sized to fit over the opening, an outer surface of the cover plate having a housing formed thereon and the pressure regulator being installed in the housing.

4. The fuel delivery system of claim 3 further including a float attached to the fuel filter to make the fuel filter buoyant.

5. The fuel delivery system of claim 4 wherein the fuel pump is a roller vane pump.

6. The fuel delivery system of claim 5 wherein the fuel pump pumps fuel to the engine at pressures in the range of 20 psi to 200 psi.

7. The fuel delivery system of claim 3 further including a fuel line extending between an outlet of the fuel pump and the pressure regulator, the cover having a fitting thereon for connecting a pressure regulator end of the fuel line to the cover, the fuel line, when connected to the cover, tethering the fuel pump to the cover wherein the fuel pump can move freely within the tank.

8. The fuel delivery system of claim 7 wherein the length of the fuel line between the fuel pump and the pressure regulator is in a range of between approximately 10 in.–15 in., the actual length of the fuel line depending upon the size of the fuel tank.

9. A fuel delivery system for use on marine vessels having an engine for propulsion, a fuel tank storing fuel supplied to the engine to run the engine, and a fuel supply line extending between the fuel delivery system and the engine, the fuel delivery system comprising:

a pressure regulator regulating the pressure of fuel pumped to the engine, the pressure regulator being mounted to the fuel tank;

a fuel pump sized to fit within the fuel tank for pumping fuel, under pressure, between the fuel delivery system and the engine;

a fuel filter also sized to fit within the fuel tank, said fuel filter resting in the fuel and tethered by a flexible hose to an inlet of the fuel pump for fuel in the tank to be drawn into the fuel pump through the fuel filter; and, a second flexible hose fuel line extending between an outlet of the fuel pump and the pressure regulator, the fuel line, when connected in place, tethering the fuel pump to the pressure regulator so the fuel pump can move freely within the tank.

10. The fuel delivery system of claim 9 further including a cover plate sized to fit over the opening, an outer surface of the cover plate having a housing formed thereon and the pressure regulator being installed in the housing, and the cover having a fitting thereon for connecting the pressure regulator end of the fuel line to the cover.

11. The fuel delivery system of claim 10 further including a float attached to the fuel filter to make the fuel filter buoyant.

12. The fuel delivery system of claim 11 wherein the fuel pump is a roller vane pump.

13. The fuel delivery system of claim 12 wherein the fuel pump is an electric pump capable of delivering fuel at pressures ranging between 20–200 psi.

14. The fuel delivery system of claim 9 wherein the fuel tank has an opening therein approximately 1.6 inches in diameter, and the fuel pump and fuel filter are sized to fit through this opening.

15. A fuel delivery system for use on marine vessels having an engine for propulsion, a fuel tank storing fuel supplied to the engine to run the engine, and a fuel supply line extending between the fuel tank and the engine, comprising:

an electric fuel pump sized for pumping fuel between the fuel tank and the engine at pressures ranging between 20–200 psi, and a fuel filter connected to an inlet of the fuel pump for fuel in the tank to be drawn into the fuel pump through the fuel filter, the fuel tank having an opening therein approximately 1.6 inches in diameter, and the fuel pump and fuel filter being sized to fit through this opening;

a pressure regulator regulating the pressure of fuel pumped to the engine, the pressure regulator being mounted to the fuel tank externally of the tank; and, a flexible hose fuel line extending between an outlet of the fuel pump and the pressure regulator, the fuel line, when connected in place, tethering the fuel pump to the pressure regulator so the fuel pump can move freely within the tank.

16. The fuel delivery system of claim 15 further including a float attached to the fuel filter to make the fuel filter buoyant.

* * * * *